US006028519A

United States Patent [19]

Dessureau et al.

[11] Patent Number: 6,028,519

[45] Date of Patent: Feb. 22, 2000

[54] TAMPER-PROOF SECURITY DEVICE AND SYSTEM

[75] Inventors: Anne C. Dessureau, Dallas; Samuel Matthew Cole, Van Alstyne; Gregory Scott Kaiser, Lewisville, all of Tex.

[73] Assignee: R. F. Tracking L.L.C., Dallas, Tex.

[21] Appl. No.: 08/924,356

[22] Filed: Sep. 5, 1997

[51] Int. Cl.[7] ..... G08B 23/00

[52] U.S. Cl. ..... 340/573.1; 340/572.1; 340/568.1; 340/539

[58] Field of Search ..... 340/540, 539, 340/568, 569, 572, 573, 514, 825.49, 572.1, 572.3, 572.8, 572.9, 573.1, 573.4, 568.1, 568.2

[56] References Cited

U.S. PATENT DOCUMENTS

| | | | |
|---|---|---|---|
| 4,176,318 | 11/1979 | Johnson et al. | 455/115 |
| 4,885,571 | 12/1989 | Pauley et al. | 340/573 |
| 4,981,453 | 1/1991 | Krishan et al. | 441/6 |
| 5,001,462 | 3/1991 | Seemann et al. | 340/574 |
| 5,032,823 | 7/1991 | Bower et al. | 340/572 |
| 5,115,223 | 5/1992 | Moody | 340/573 |
| 5,117,222 | 5/1992 | McCurdy et al. | 340/573 |
| 5,512,879 | 4/1996 | Stokes | 340/573 |
| 5,612,675 | 3/1997 | Jennings et al. | 340/573 |
| 5,627,520 | 5/1997 | Grubbs et al. | 340/572 |

*Primary Examiner*—Jeffery A. Hofsass
*Assistant Examiner*—Van T. Trieu
*Attorney, Agent, or Firm*—Lawrence R. Youst

[57] ABSTRACT

A tamper-proof security device for preventing the unauthorized removal of an individual or asset from a secured area and a system for use with the same is disclosed. The device is attached to an individual or asset and comprises a transmitter having a transmitter circuit therein for generating a digitally encoded signal on a predetermined frequency. At least one wire is disposed within the device for creating continuity in the transmitter circuit when the device is attached to the individual or asset. A power source is disposed within the transmitter which is electrically connected to the transmitter circuit when a switching mechanism is operated, thereby activating the transmitter circuit. Once the transmitter circuit is activated, the transmitter circuit generates the digitally encoded signal in response to a discontinuity in the wire.

14 Claims, 5 Drawing Sheets

TAMPER-PROOF SECURITY DEVICE AND SYSTEM

TECHNICAL FIELD OF THE INVENTION

The present invention relates, in general, to the field of security devices and, in particular to, a system for preventing the unauthorized removal of individuals or assets from a secured area or facility utilizing a tamper-proof transmitting device.

BACKGROUND OF THE INVENTION

Without limiting the scope of the invention, its background is described in connection with abduction of infants from hospitals, as an example.

Over 4.2 million births take place at approximately 3,500 birthing facilities in the United States each year. Based upon a study of cases by the National Center for Missing and Exploited Children (NCMEC) between 1983 and 1992, the best estimate for the nationwide incidents of successful infant abductions, by non-family members, is between 12 and 18 annually. Because there is no reporting requirement or mandated centralized collection of data for infant abduction cases, it is likely that the actual number of cases is even higher. While the crime of infant abduction may not be of epidemic proportion, abductions by non-family members of infants from hospitals is emotionally devastating for the victim's parents and is clearly a subject of concern for nurses, hospitals, law enforcement as well as the NCMEC.

The majority of the infants that are abducted annually have been taken from hospitals. The abductions typically have no boundaries in terms of location or size of the hospital, or of race, sex or socioeconomic background of the infant. The typical hospital abduction case involves an unknown abductor impersonating a nurse, hospital employee, volunteer or relative in order to gain access to an infant. The obstetrics unit is typically open and inviting. It can be filled with medical and nursing staff, visitors, students, volunteers and participants in parenting and newborn care classes. The number of new and changing faces on the unit is high, thus making the unit an area where a stranger is unlikely to be noticed.

Because there is generally easier access to a patient's room than to a newborn nursery and because a newborn infant spends increasingly more time with the mother rather than in the traditional nursery setting, most abductors obtain access to the infant directly from the mother's arms. In fact, statistics from the NCMEC study indicate that nearly two-thirds of the infants abducted from a hospital were abducted from the mother's room.

While infant abductions are usually carried out by women who are not criminally sophisticated, these crimes are not committed by the stereotypical stranger. In most cases, the offenders make themselves known and achieve some degree of familiarity with the hospital personnel, procedures and the victim's parents. The abductor usually visits the nursery unit for several days before the abduction, repeatedly asking detailed questions about healthcare facility procedures and the layout of the maternity unit. Additionally, the abductors often visit or surveil more than one hospital in a community to assess the level of security and to explore the infant population.

Heretofore, hospitals have taken reasonable precautions to prevent infant abduction, such as attaching corresponding identification bands to the mother and the infant, utilizing hospital staff to continuously monitor newborn nurseries and using video surveillance equipment to monitor newborn nurseries as well as the maternity unit. It has been found, however, that these measures do not prevent infant abductions from hospitals. It has also been found that due to the extreme emotional trauma of the victims of infant abductions, the potential liability to hospitals following infant abductions is substantial.

Need has therefore arisen for an improved system for preventing the unauthorized removal of babies from the maternity unit. A need has also arisen for a system that includes an identification band that may be attached to the infant that sends a signal if an abductor attempts to remove the band. A need has further arisen for a system that responds to the signal sent by the band by generating an audible or visual alarm or by communicating with additional subsystems to secure the maternity unit if a band has been tampered with or cut. A need has also arisen for a band that provides visual cues to indicate the operation mode of the band.

SUMMARY OF THE INVENTION

The present invention disclosed herein comprises a system for preventing unauthorized removal of individuals or assets from a secured area or facility. The system includes a transmitter that may be attached to an individual or an asset that transmits a signal in response to tampering or removal. The system also has a receiver that responds to the signal sent by the transmitter by generating an audible or visual alarm or by communicating with additional subsystems to secure an area or facility.

In one embodiment, the system of the present invention comprises a tamper-proof transmitting device that includes a band that carries a transmitter. The transmitter has a transmitter circuit therein for generating a digitally encoded signal on a predetermined frequency. At least one wire is disposed within the band for creating continuity in the transmitter circuit when the band is attached. A power source is disposed within the transmitter which is electrically connected to the transmitter circuit when a switching mechanism is operated to activate the transmitter. After the transmitter is activated, the transmitter circuit generates a digitally encoded signal in response to a discontinuity in the wire.

In another embodiment the system of the present invention comprises a tamper-proof security device having a transmitter disposed within a housing that is attached to an asset using an adhesive layer. The transmitter has a transmitter circuit therein for generating a digitally encoded signal on a predetermined frequency. One or more wires are disposed on an outer surface of the housing proximate the adhesive layer such that a discontinuity will be created in the wires in response the removal of the device from the asset. The device includes a power source that is disposed within the housing. A switching mechanism is inserted into the housing for activating the transmitter circuit by electrically connecting the power source to the transmitter circuit. After activation, the transmitter circuit generates the digitally encoded signal in response to a discontinuity in the wires.

The switching device may be inserted into the housing via a door. A spring loaded piston disposed in the housing may bias the switching mechanism against the door after the switching device is inserted into the housing to prevent the removal of the switching mechanism from said housing. The switching device trips a microswitch when the switching mechanism is disposed within the housing. The microswitch electrically connecting the power source to the transmitter circuit.

In either embodiment, the system also includes a plurality of receiving devices for receiving the digitally encoded signal from the transmitter. The receiving devices compare the digitally encoded signal with a predetermined value to selectively active an alarming mechanism which may include an audible alarm, an LED or a secure an area. The receiving units may also determine which of the transmitters is transmitting the digitally encoded signal. A monitoring unit may be connected to each of the receiving units to provide a user interface to said system.

DETAILED DESCRIPTION OF THE INVENTION

While the making and using of various embodiments of the present invention are discussed in detail below, it should be appreciated that the present invention provides many applicable inventive concepts which can be embodied in a wide variety of specific contexts. The specific embodiments discussed herein are merely illustrative of specific ways to make and use the invention, and do not delimit the scope of the invention.

In general, the system of the present invention comprises a small transmitting unit that can be worn on a wrist or an ankle or placed on valuable equipment to prevent unauthorized removal of individuals or assets from a secured area. For example, when a band encompassing a transmitter circuit is cut or removed from the wrist or ankle, a signal is transmitted from the transmitting unit which can be detected within a predefined range by a remotely located receiving unit that is tuned to the oscillating frequency of the transmitting unit.

The receiving unit can have several functions. For example, the receiving unit could generate an audible alarm or a visible alarm, such as an LED, or the receiving unit could activate relay contacts which would enable a larger remote alarm subsystem to recognize that a transmitting unit has been removed in the area covered by a particular receiving unit. Therefore, the system of the present invention is well suited for use on newborn babies in hospitals, Alzheimer's patients or the mentally impaired. The system is also well suited for asset control including computers and other relatively expensive yet easily moveable items.

Figure 1A:
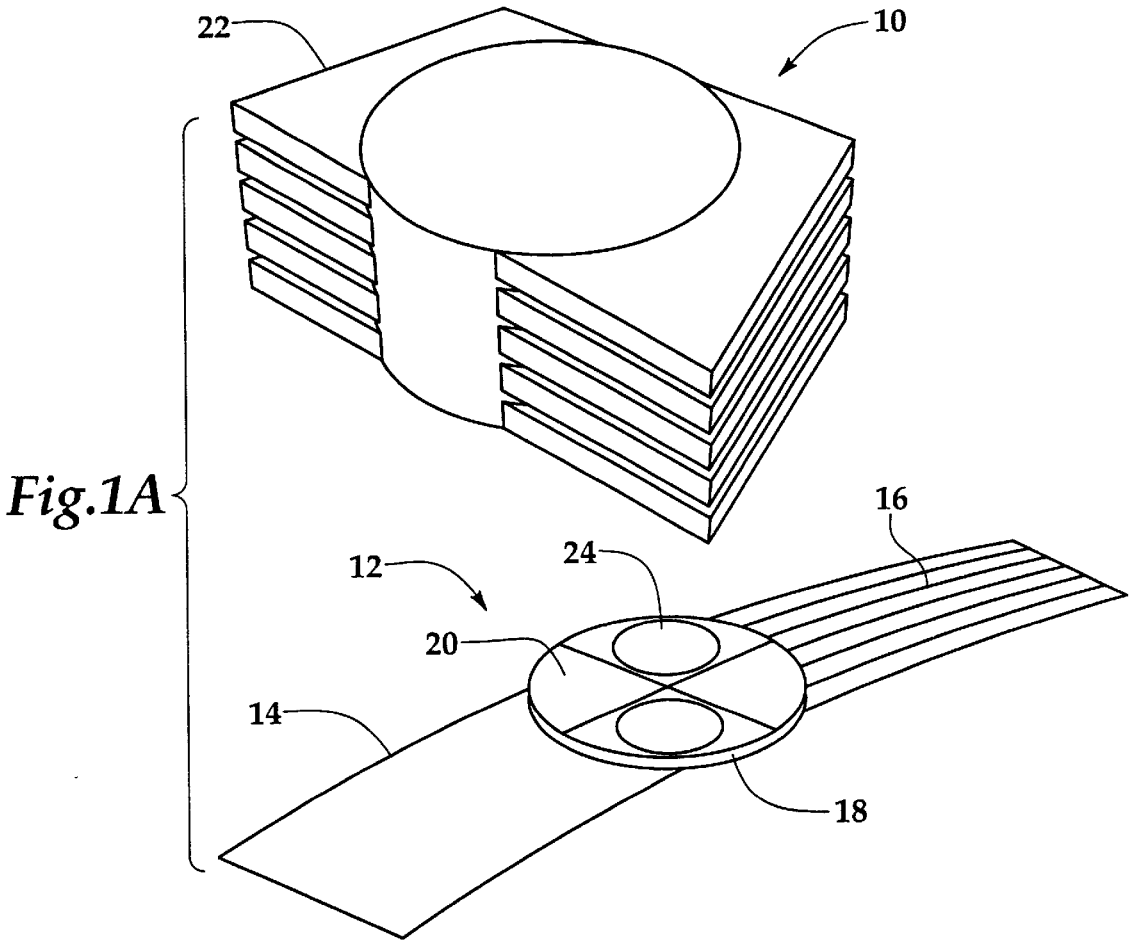
FIG. 1A illustrates a first embodiment of the tamper proof security band device of the present invention.

FIG. 1A is a depiction of the system of the present invention and is denoted generally as 10. The system 10 includes a transmitting unit 12 that comprises a band 14 consisting of a plurality of wires 16 and a housing unit 18 encompassing an integrated circuit board, a battery and an antenna. The integrated circuit board uses the battery for a power supply and the antenna to transmit a modulated signal.

The transmitting unit 12 is attached to an individual or device by wrapping and connecting the open end of the band 14 to the transmitter circuit enclosed in the housing unit 18 of the transmitting unit 12. Once the band 14 is in place, an electrical connection is made by using a special tool for twisting a switching mechanism 20, located on the housing unit 18. When the band is locked into place by twisting the switching mechanism 20, the transmitting unit 12 is activated. Upon activation, the transmitting unit 12 sends a signal to a receiving unit 22 which may activate an audible initiation alarm. A visual indicator 24 may be used to display the activation state of transmitting unit 12. For example, before switching mechanism 20 is turned to activate transmitting unit 12, the visual indicators 24 may be red. Following activation, by rotating switching mechanism 20, the visual indicators 24 may be green. The highly visible visual indicators 24 provide readily accessible visual cues as to the operation state of each transmitter unit 12.

The band 14 of the transmitter unit 12 may consist of a six conductor ribbon cable or other configuration capable of carrying a plurality of wires 16. One or more of the wires 16 may carry the current for operating the transmitter unit 12. The hot wire 16 may vary among transmitting units 12 to further enhance the security of system 10. If a discontinuity occurs within one of the wires 16, the transmitter unit 12 will continuously transmit a frequency signal to a remote receiving unit 22 tuned to the frequency of transmitting units 12, causing an alarm or a response from the receiving unit 22 indicating a transmitting unit 12 has been tampered with or cut. The transmitter unit 12 will continuously transmit a signal until the transmitter unit 12 is disabled. The transmitter unit 12 cannot be reused once the band 14 has been tampered with or cut.

The receiving units 22 may be similar in appearance to a smoke detector and can be mounted or placed in a variety of locations, preferably within the proximity of the transmitting units 12 frequency range. The receiving units 22 require an external power supply and house an internal loop antenna. The receiving units 22 are tuned to receive and decode a frequency signal from transmitting unit 12 within a set bandwidth, for example a 303.825 megahertz (MHZ) signal with a bandwidth of 0.300 MHZ. If the transmitting unit 12 is designed to transmit at a frequency of 303.825 MHZ, the receiving units 22 circuit would have to be tuned to receive signals at 303.825 MHZ with a variance of +/−0.15 MHZ.

The signal transmitted by transmitting units 12 will activate and latch an onboard relay to provide an alarm condition indicated by an audible alarm or LED on a receiving units 22 or a display system coupled to the receiving units 22. The receiving units 22 may also provide a contact closure once a signal from a transmitting unit 12 is detected, which may, for example, initiate door locking devices, closed circuit television systems, or elevator shut down to prevent unauthorized removal of an individual or asset from a secure area or facility. Specifically, the receiving units 22 with the transmitting unit 12 of system 10 may be used in health care facilities for infant abduction or patient wanderer control.

Figure 1B:
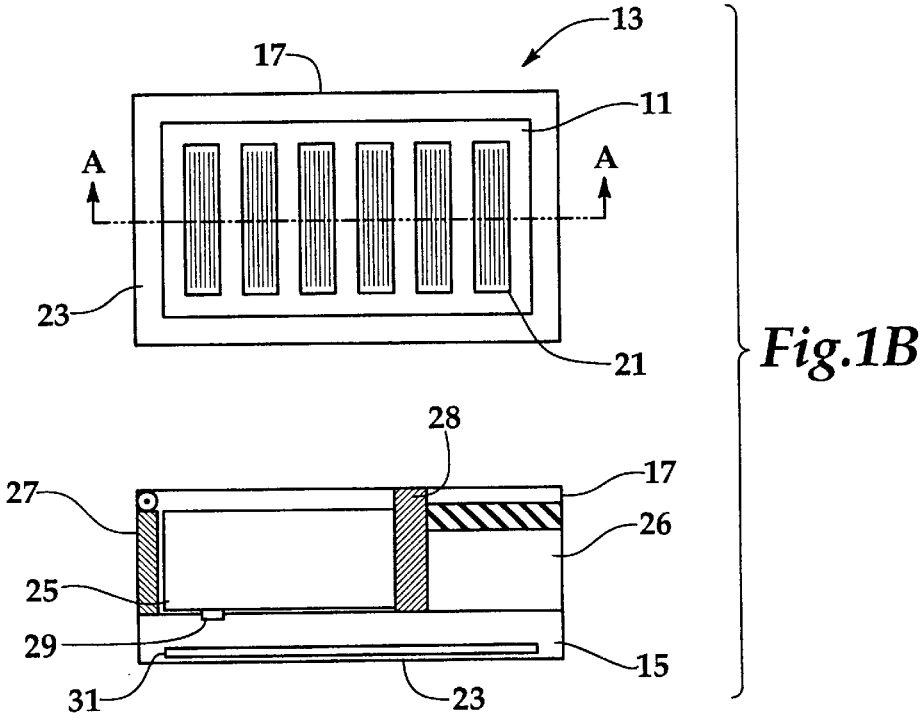
FIG. 1B depicts a second embodiment of the tamper proof security band device of the present invention.

In FIG. 1B, another embodiment of the present invention is depicted and generally designated 13. Transmitting unit 13 includes an integrated circuit board 31 that is enclosed in lower section 15 of housing 17. A plurality of wires 21 are disposed on the bottom surface 23 of housing 17. Surrounding wires 21 is an adhesive layer 11 that is used to attach the transmitting unit 13 to an asset.

Once the transmitting unit 13 is in place, an electrical connection is made by inserting a switching mechanism 25 into upper section 26 of housing 17 to engage microswitch 29. The switching mechanism 25 is inserted by opening door 27 and sliding switching mechanism 25 against spring mounted piston 28. After piston 28 is sufficiently displaced, door 27 may swing shut and switching mechanism 25 will be urged against door 27 by piston 28. The switching mechanism 25 may carry a battery therein such that the transmitting unit 13 is activated when switching mechanism 25 is inserted into upper section 26 of housing 17. Upon activation, the transmitting unit 13 sends a signal to a receiving unit 22 which may activate an audible initiation alarm.

After the transmitter unit 13 is activated, if a discontinuity occurs within one of the wires 21, the transmitter unit 13 will continuously transmit a frequency signal to a remote receiving unit 22 tuned to the frequency of transmitting units 13, causing an alarm or a response from the receiving unit 22 indicating a transmitting unit 13 has been tampered with or removed. The transmitter unit 13 will continuously transmit a signal until the transmitter unit 13 is disabled. The wires 21 are configured within the adhesive layer such that the removal or attempted removal of the transmitter unit 13 from an asset will cause a discontinuity. Also, the removal or attempted removal of the switching element 25 from upper section 26 of housing 17 will disengage microswitch 29 similarly causing the transmitter unit 13 to continuously transmit a frequency signal to a remote receiving unit 22.

Figure 2:
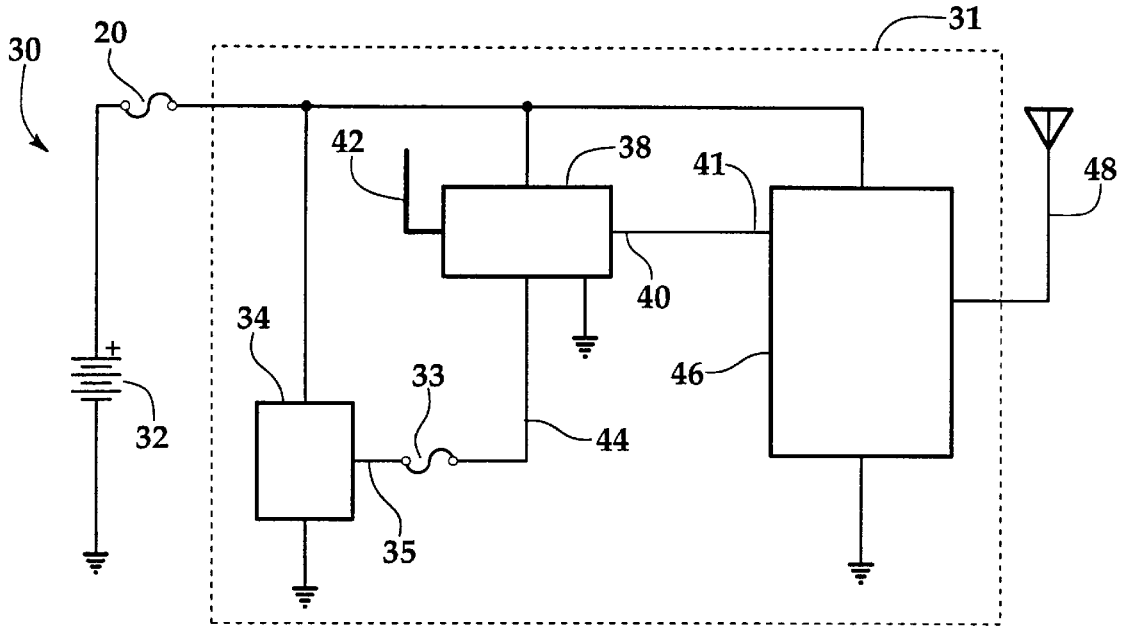
FIG. 2 is a high-level block diagram illustrating the transmitter circuit of the present invention.

FIG. 2 is a high level depiction of the present inventions transmitter circuit and is denoted generally as 30. The transmitter circuit 30 is located within housing unit 18 of transmitting unit 12. Transmitting circuit 30 comprises of a power source 32, such as a 3 volt lithium battery, various integrated circuit (IC) components, standard analog electronic devices, and an antenna 48. The band connection 33 is attached to the switching mechanism 20 of the transmitting unit 12 such that upon rotation and activation, power source 32 supplies power to the integrated circuit board 31.

The integrated circuit board 31 comprises an IC timer chip 34. The timer chip 34 initially outputs a signal 35 which may be a one second pulse to the encoder 38 once connections 33 and 20 are made. This is a initialization response signifying that the transmitting unit 12 has been activated. The pulsed output signal 35 enables the encoder 38 to transmit an initial signal which may produce an alarm in the receiving unit 22 indicating that a transmitting unit 12 has been activated. Preceding activation, the output 35 of the timer chip 34 is high. When the input 44 of the encoder 38 from the timer chip 34 is high, the encoder 38 is not enabled and there is no encoder output 40.

Encoder 38 may be configured to output a 9 bit code 42 and, when enabled, outputs the same 9 bit code 40 to the transmitting modulator 46. The output 40 of the encoder 38 is controlled by the output 35 of the timer chip 34. This, in turn, is controlled by the wires 16 comprising the interior of the band 14. If any of these wires 16 are tampered with or cut, the output 35 from the timer chip 34 is pulled low and the output 40 from the encoder 38 is enabled. The input to the transmitter 46 is a string of ones and zeros or a Binary Coded Decimal (BCD) signifying a value. This value is then modulated to a configured frequency by the transmitter 46 and transmitted through antenna 48. This transmitted value will be decoded at the receiving unit 22 causing the receiving unit 22 to alarm.

The system 10 of the present invention sends a digital signal from transmitting unit 12 to receiving unit 22. One reason a digitally encoded signal is transmitted is so that a simply carrier signal of the same frequency will not activate the receiving unit 22 causing a false alarm. Also, because the transmitter circuit 30 modulates and transmits a 9-bit code from the encoder 38 which is decoded by the receiving unit 22, this value can be configured differently for each transmitting unit 12 allowing the system 10 to keep track of individual transmitting units 12.

Figure 3:
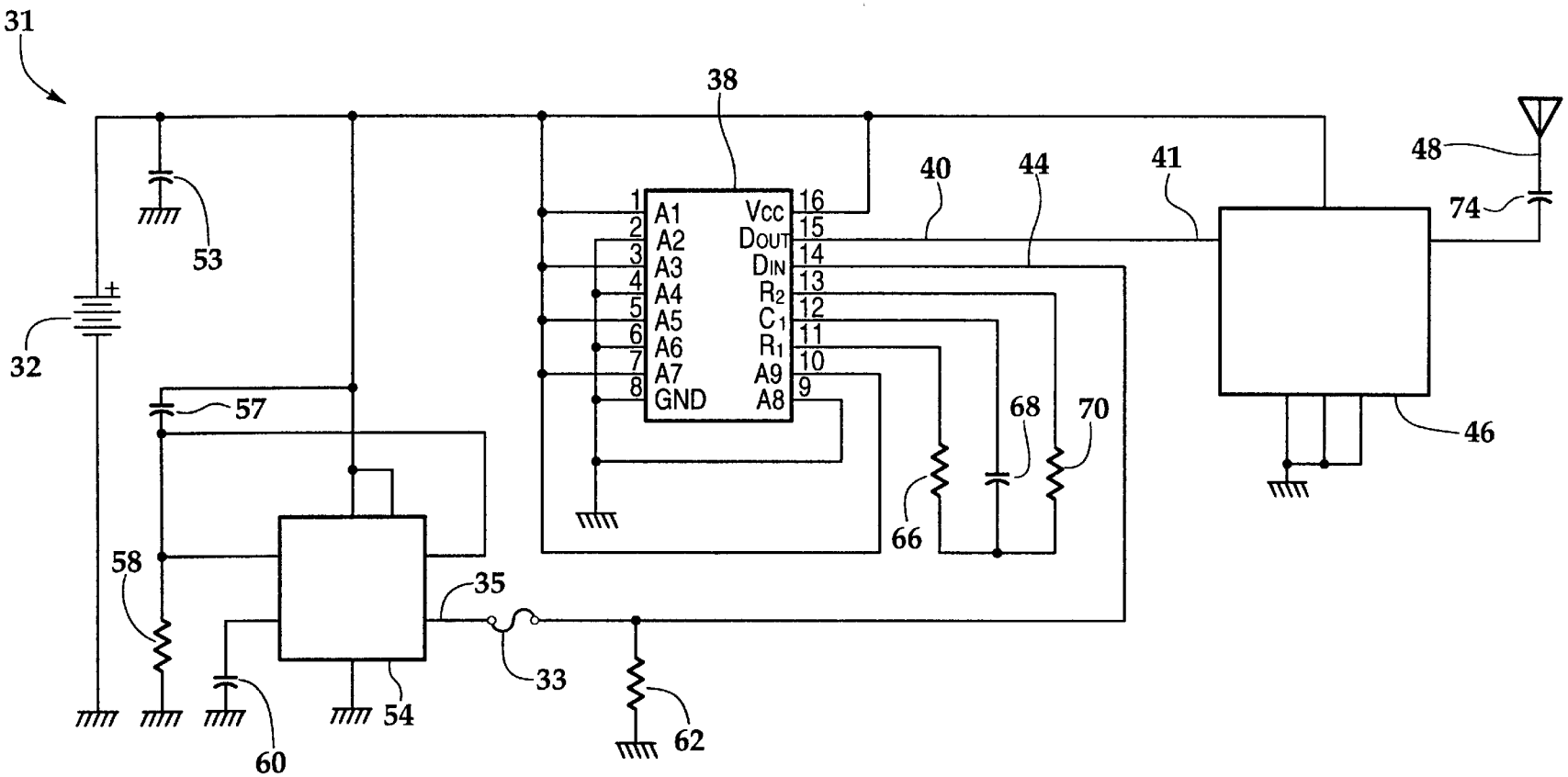
FIG. 3 is a schematic diagram of the transmitter circuit of the present invention.

Yet another unique advantage of the system 10 of the present invention is that even after the transmitting unit 12 has been activated, the transmitting unit 12 does not operate until the transmitting unit 12 has been tampered with or cut. This feature minimizes power consumption, thereby prolonging the use of the transmitting units 12. FIG. 3 is a schematic drawing of the integrated circuit board of a transmitting unit 12 and is denoted generally as 31. Integrated circuit board 31 utilizes commonly available surface mount electronic components to generate a signal in response to discontinuities within the circuit. The integrated circuit board 31 comprises a plurality of IC chips, a power source and typical analog components used to trigger the output of a frequency signal under certain conditions.

In one embodiment, the integrated circuit board 31 could comprise the following commonly available surface mount electronic components. The source of power 32 used to supply power to the integrated circuit 31 is a three volt lithium battery. Capacitor 53 is a simple 0.01 microfarad ($\mu$F) capacitor used as a filter capacitor for AC noise from the battery 32. The integrated circuit board 31 may also consist of a TLC555 timer chip 54 which generates a one second pulse upon activation of the transmitter unit 12. The one second pulse is the time constant of the TLC555 timer chip 54. The time constant is configured by the capacitance of capacitor 57 and the resistance of resistor 58 which are respectively 1.0 $\mu$F and 1.0 megaohm (M$\Omega$) which, when multiplied together and taken the inverse of, will give the one second pulse for the output. This one second pulse only occurs upon activation of the transmitting unit 12. Capacitor 60 is a 0.01 $\mu$F bypass capacitor used to eliminate AC noise produced by the TLC555 timer chip 54.

The one second pulse enables a binary coded output from the encoder 38, a MC145026D, which is transmitted at a frequency of 303.825 MHZ through the AT744TX transmitter 46. This activates the receiving unit 22 causing a three second alarm signifying that the transmitting unit 12 has been activated. Once initial activation is made with receiving unit 22, the output signal from the TLC555 timer chip 54 remains high. The high signal disables the MC145026D encoder 38 so there is no data output 40 from pin 15.

Once the transmitter unit 12 is connected, if any of the wires 16 are broken or tampered with, the high voltage signal from output 35 going into pin 14 of encoder 38 is pulled low by resistor 62. Resistor 62 is a 47 k$\Omega$ pull down resistor that pulls the high signal to ground when any of the wires 16 are tampered with. When pin 14 is pulled low, a BCD value is generated on pin 15 as an output signal 40 from MC145026D encoder 38.

The function of MC145026D encoder 38 is to generate a configured binary code so that a receiving unit 22 tuned to this signal will respond. Pins A1 through A9 can be configured to a specific BCD value. The digitally encoded train of alternating ones and zeros is set by pins A1 through A9. The signal can be set to any combination desired. In one embodiment, the binary data transmitted is a predetermined value which can be changed for each transmitting unit 12. This enables surveillance of individual transmitting units 12.

The output signal 40 from MC145026D encoder 38 on pin 15 is a string of ones and zeros modulated to a frequency of 303.825 MHZ in an AT744TX transmitter 46 and transmitted through the antenna 48. The output signal goes out through capacitor 74 which has a capacitance of 8.0 picofarad (Pf). This is so the output resistance of the AT744TX transmitter 46 is matched to the antenna 48 for maximum power transfer. The antenna 48 can either be laid out as a trace on the circuit board 31 or as a discrete wire on the inside of housing unit 18. Resistor 66, capacitor 68, and resistor 70 are respectively 74 kΩ, 0.01 μf, and 39 kΩ used to set the bit rate of the MC145026D encoder 38. The MC145026D encoder 38 in this instance is set at a bit rate of 2 KHz. This value can be varied as long as the same variations are made to the decoder in the circuit board of receiving units 22.

Figure 4:
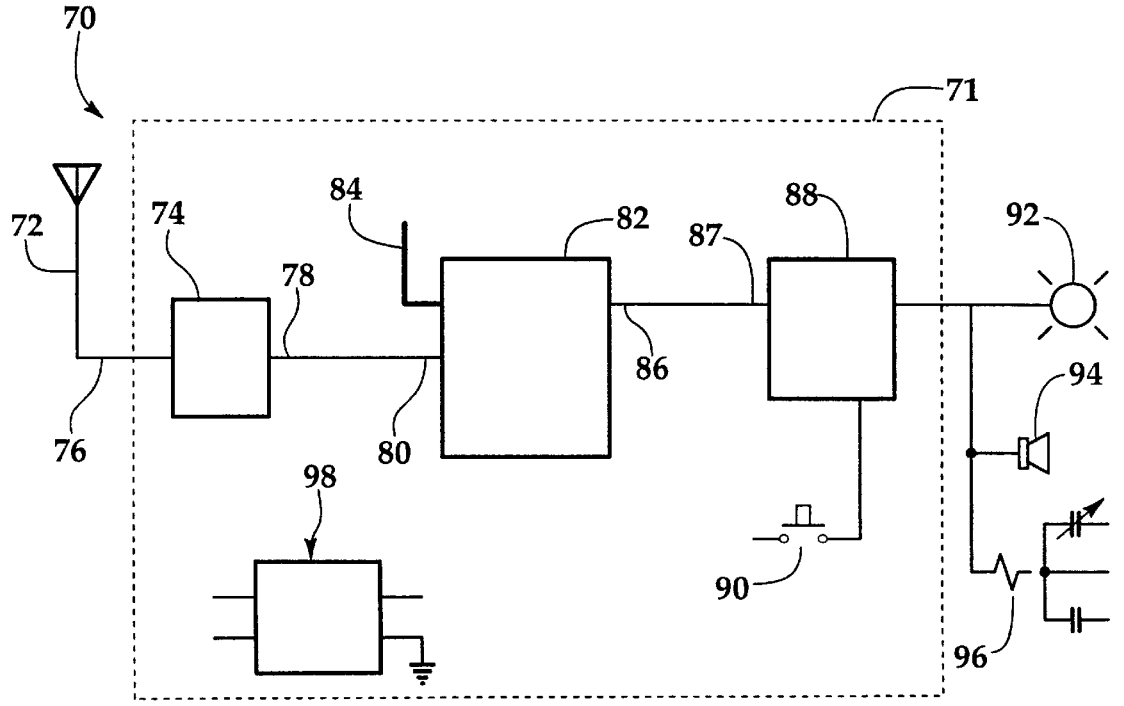
FIG. 4 is a high-level block diagram illustrating the receiver circuit of the present invention.

FIG. 4 is a high level depiction of the present inventions receiver circuit and is denoted generally as 70. The receiver circuit 70 comprises of a receiver antenna 72, a integrated circuit board 71, and a plurality of alarm indicators such as, a light emitting diode (LED) 92, a piezzo buzzer 94, and a relay switch 96.

The power to the integrated circuit board 70 is supplied by a voltage regulator 98. The voltage regulator 98 supplies the power needed by the plurality of IC components that make up much of the intricate circuitry of the integrated circuit board 70.

The antenna 72 produces a small electric current generated from electromagnetic induction produced by the frequency transmitted by the transmitting units 12. The small electric current varies with the frequency of the transmitted signal. This input signal 76 is then amplified and demodulated by the receiver 74. The demodulated signal is then output 78 which is the same BCD value generated by the transmitted unit 12.

The demodulated signal 78 is input 80 to the decoder 82. The decoder 82 decodes the 9 bit binary code from the receiver 74. The decoder 82 compares the input signal 80 with set input 84. Once a successful comparison is made, the decoder 82 sends an output signal 86 to flip flop 88.

The flip flop 88 latches producing a high signal when an output 86 is generated by the decoder 82 and does not reset until the receiving unit 22 is reset by the reset switch 90 or the power 98 of the integrated circuit board 71 is turned off.

Once the flip flop 88 is latched, for example, a light emitting diode (LED) 92 is activated and an adjustable audible alarm 94 is activated. A relay switch 96 is also activated which can be used to physically activate other devices such as door locking devices, closed circuit television systems or elevator shut down to prevent unauthorized removal of an individual or asset from a secured area or facility.

Figure 5:
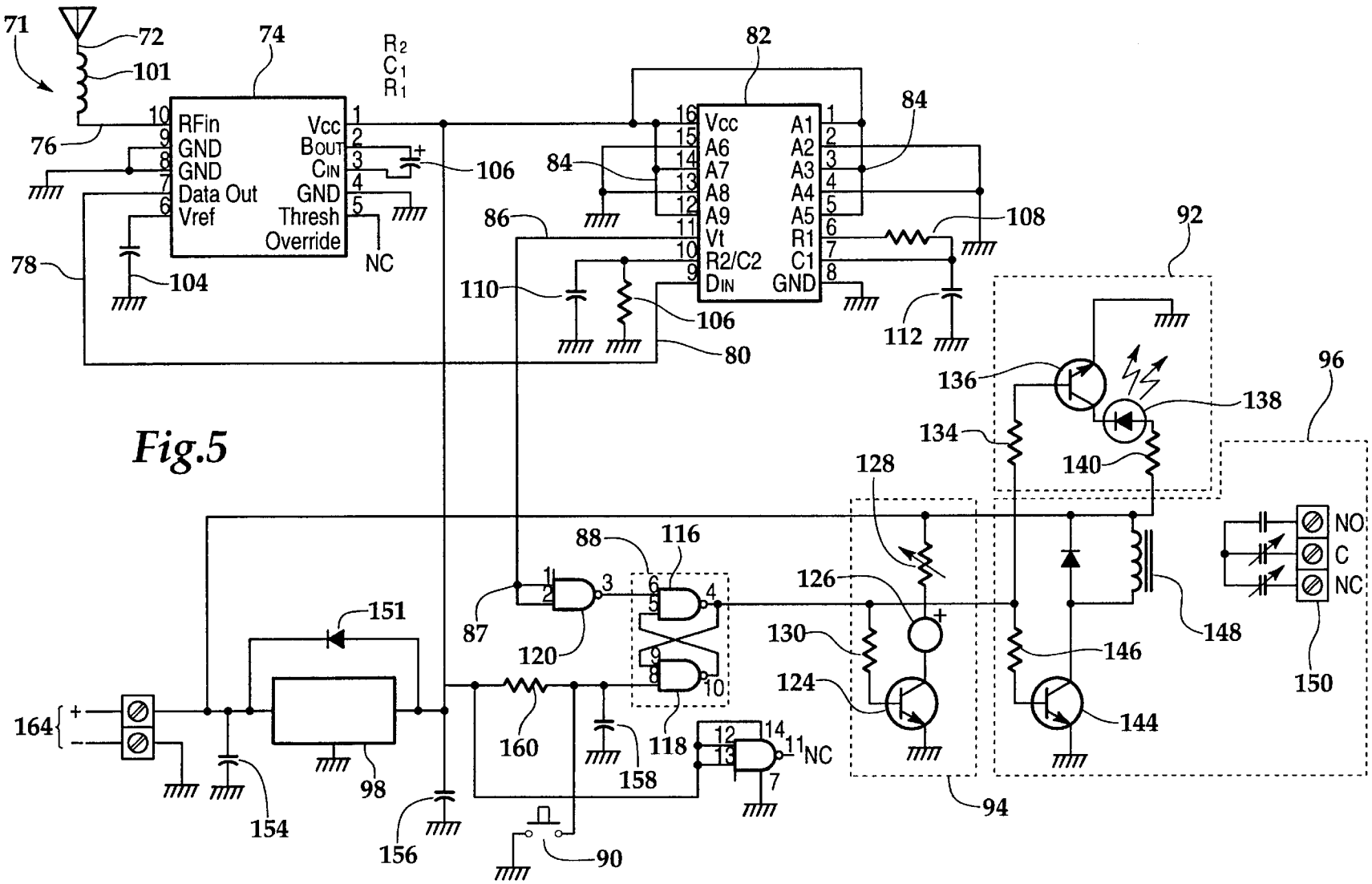
FIG. 5 is a schematic diagram of the receiver circuit of the present invention.

FIG. 5 is a schematic drawing of an integrated circuit board for receiving unit 22 and is denoted generally as 71. Integrated circuit board 71 utilizes commonly available surface mount electronic components to generate a signal. The integrated circuit board 71 comprises a plurality of IC chips, a power source and typical analog components used to trigger outputs initiated by a frequency signal. The generated signal produces visual as well as audible alarms indicating that a transmitting unit 12 has been tampered with or cut.

In one embodiment, the integrated circuit board 71 could comprise the following commonly available surface mount electronic components. The transmitted frequency signal from transmitting unit 12 induces a small electric current in receiving antenna 72. The small current varies with the frequency of the transmitted signal. The receiver antenna 72 may have four turns of number 20 wire and 9.72 inch diameter and the circumference is Lambda over 4 which gives the transmitting units 12 and the receiving units 22 a read range radius of approximately fifty feet around each receiving unit 22. Inductor 101 is a tuning inductor used for maximum power transfer of the signal induced in antenna 72.

RX1110 receiver 74 amplifies and demodulates the transmitted frequency signal input. The demodulated signal has the value of the transmitted signal. The BCD value demodulated from the incoming frequency signal is output 103 from pin 7 of RX1110 receiver 74 to pin 9 of MC145028 decoder 102. The demodulated signal should be the same ones and zeros signal that the transmitter unit 12 transmitted. The 1 μf capacitor 104 and the 10 μf capacitor 106 are filter caps for AC noise generated by the RX1110 receiver 74.

MC145028 decoder 102 is used to compare the BCD input value from RX1110 receiver 74 to the BCD value configured for MC145028 decoder 82. Pins A1 through A9 are used to configure MC145028 decoder 82 to correspond to the way MC145026D encoder 38 of transmitting units 12 are configured. The BCD value input to MC145028 decoder 82 is compared to the programmed configuration of pins A1 through A9. If a match occurs the MC145028 decoder 82 is enabled and an output at pin 11 is high. Resistor 106, resistor 108, capacitor 110 and capacitor 112 set the time constant for the bit rate of the BCD value. If the bit rate values change the same changes must be reflected on the MC145026D decoder 38.

Once a match is successfully completed, a set reset circuit called a flip-flop 88 is latched or set. The output of the MC145028 encoder 82 is normally low and the nand gate 120 inverts the normally low signal to a high signal. With a source of power from the power supply 98 and a high input from nand 120 the output of flip flop 88 is low resulting in none of the alarming mechanisms being activated. Once the MC145028 decoder 82 is enabled, the nand gate 120 inverts the signal low causing flip flop 88 to set. Flip flow 88 comprises nand gate 116 and nand gate 118, which make up the logical configuration that determines when to set and when to reset. Once flip flop 88 is set this provides the necessary power to the plurality of transistors that control the source of power to the various alarm units and switches.

Integrated circuit board 71 includes a plurality of alarming mechanisms. Circuit 94 is the piezzo alarm buzzer. Once a signal occurs, a latch is set which supplies the turn on voltage to the base of transistor 124 allowing a source of power 164 to turn on the piezzo alarm buzzer 126. Potentiometer 128 is used to adjust the audible alarm buzzer 126. Resistor 130 is used to regulate the amount of voltage supplied to transistor 124.

Next, once flip flop 88 sets, the LED 92 is activated by turning on transistor 136. Resistor 134 creates a voltage drop across the base of transistor 136 to prevent excess voltage across the base of the transistor.

Circuit 96 comprises the components used to activate a switch connection 150. Transistor 144 is supplied with the turn on voltage from the output of flip flop 116. A voltage drop across resistor 146 is used to obtain the right base voltage for transistor 144. This can be use to unlatch a switch that is normally closed or latch a switch that is normally open.

The power source to the circuits IC components is from the 3.3 voltage regulator 98. Diode 151 is used to keep any current that might flow in the reverse direction from flowing back into regulator 98 which could damage the regulator 98.

Capacitor 154 is used to shunt any AC noise which might appear from the power sources input 164. Capacitor 156 is used to shunt AC noise which might be generated by the 3.3 voltage regulator 98. In one embodiment, a 24 VDC supply may be used to power the 3.3 voltage regulator 98.

The alarm mechanisms of receiver units 22 will continue to alarm until the 24 VDC input 164 is 10O disconnected or switch 90 is engaged. If input 164 is disconnected then power to all circuitry is interrupted. If reset switch 90 is engaged then just the power to the IC components is disrupted causing flip flop 88 to reset.

Figure 6:
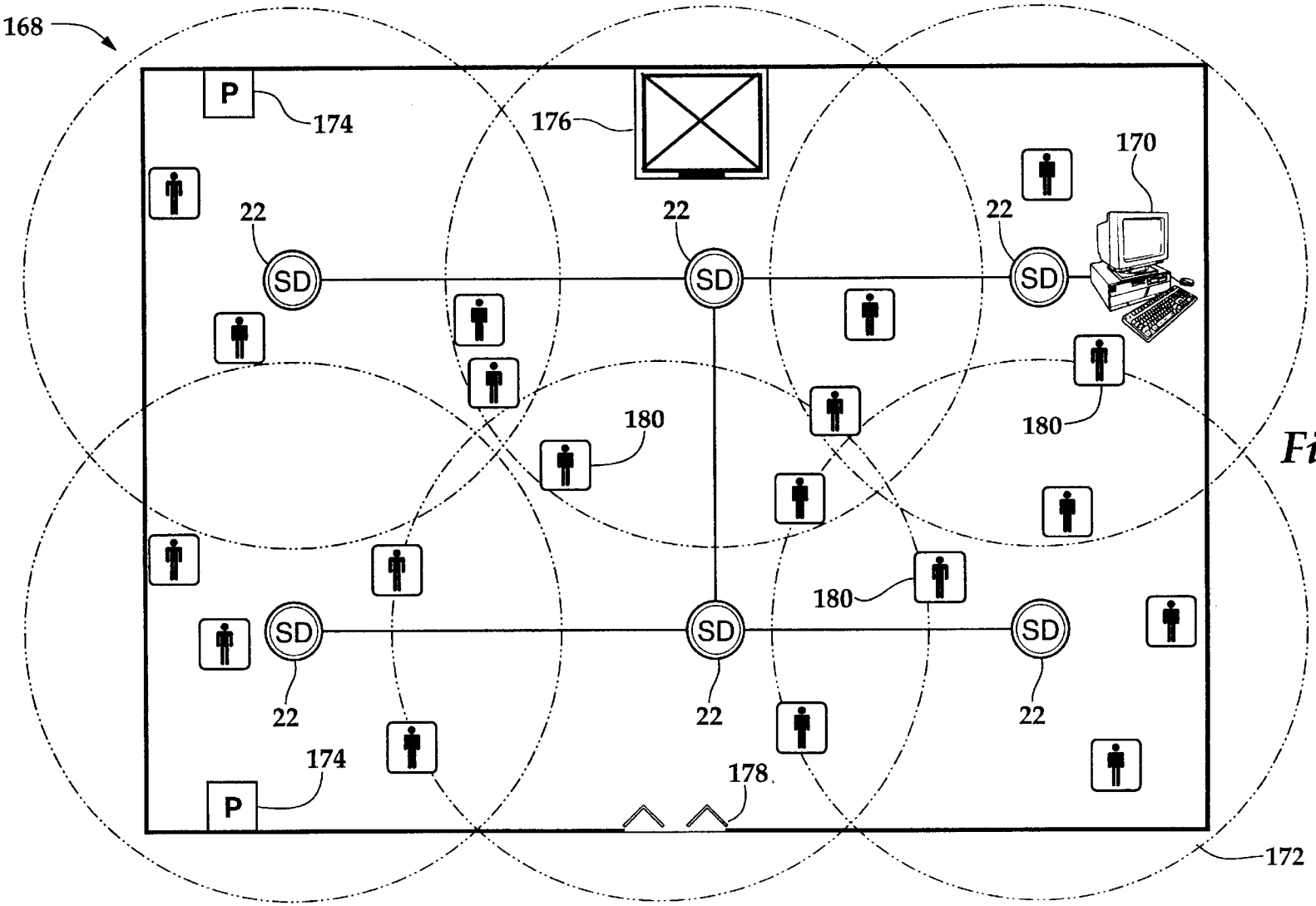
FIG. 6 illustrates a secured area including the system of the present invention.

In operation the system 10 of the present invention may be implemented as illustrated in FIG. 6 in an area denoted generally as 168. For example, a computer system 170 may be used in conjunction with system 10 to monitor a vast array of individuals 180 within an area 168. A software routine may be used on computer system 170 to generate a series of actions to configure receiving units 22 and to respond to signals from receiving units 22. The computer system 170 may be used to identify a specific individual 180 in response to a unique signal received from a transmitting unit 12 as well as the general location of the individual 180 based upon which receiving unit 22 received the signal from the transmitting unit 12.

The software routine may be utilized to step through a series of modulated encoded frequency values which may be placed on the decoder input 84 of receiver units 22. If the array of modulated values placed on the decoder input 84 is matched by a signal received from a transmitting unit 12, the receiving unit 22 will generate on output signal on the decoder output 86. The output signal 86 may be used by the software routine to identify the individual 180 and the location of the individual 180 so that proper actions may be taken.

Several areas 168 may be monitored at once using one computer system 170 with each area 168 using a unique frequency to transmit signals. For example, several floors in a hospital may be equipped with a system 10. In this embodiment, identification information is encoded in the signal from each transmitting unit 12. Receiving units 22 are strategically placed so that the areas 168 are fully within the read range 172 of the receiving units 22, which may be a fifty foot radius around receiving units 22. Once the computer system 170 receives a signal from a receiving unit 22, the computer system 170 may activate an alarm 174, lock and/or close exit doors 178, and disable or render inactive elevators 176 in the area 168 where the signal originated.

While this invention has been described with a reference to illustrative embodiments, this description is not intended to be construed in a limiting sense. Various modifications and combinations of the illustrative embodiments as well as other embodiments of the invention, will be apparent to persons skilled in the art upon reference to the description. It is, therefore, intended that the appended claims encompass any such modifications or embodiments.

What is claimed is:

1. A tamper-proof security band for preventing an unauthorized removal of a subject from a secured area comprising:

a band for encircling a part of said subject;

a transmitter carried on said hand;

a transmitter circuit within said transmitter for generating a digitally encoded signal on a predetermined frequency;

at least one wire disposed within said band for creating continuity in said transmitter circuit when said band is attached around said subject;

a power source disposed within said transmitter; and a switching mechanism rotatably mounted to said transmitter for activating said transmitter circuit by electrically connecting said power source to said transmitter circuit when said switching mechanism is rotated from a disengaged position to an engaged position, said switching mechanism including a first visual indicator that visually indicates that the switching mechanism is in the disengaged position and a second visual indicator that visually indicates that the switching mechanism is in the engaged position when the switching mechanism is rotated from the disengaged position to the engaged position, whereby said transmitter circuit generates said digitally encoded signal in response to a discontinuity in said wire.

2. The tamper-proof security band as recited in claim 1 wherein said transmitter sends an initiation signal when said switching mechanism is engaged.

3. The tamper-proof security band as recited in claim 1 wherein said first visual indicator further includes a first color to indicate said transmitter circuit is not activated and said second visual indicator further includes a second color to indicate said transmitter circuit is activated.

4. The tamper-proof security band as recited in claim 1 wherein said at least one wire further includes a plurality of wires in parallel each carrying a current.

5. The tamper-proof security band as recited in claim 1 wherein said at least one wire further includes a plurality of wires and wherein said plurality of wires includes at least one wire not carrying a current.

6. The tamper-proof security band as recited in claim 1 wherein said subject is an individual.

7. The tamper-proof security band as recited in claim 1 wherein said subject is an asset.

8. The tamper-proof security band as recited in claim 1 wherein said switching mechanism is a rotatable locking mechanism.

9. A system for preventing an unauthorized removal of a subject from a secured area comprising:

at least one tamper-proof transmitting device comprising:

a band for encircling a part of said subject;

a transmitter carried on said band;

a transmitter circuit within said transmitter for generating a digitally encoded signal on a predetermined frequency;

at least one wire disposed within said band for creating continuity in said transmitter circuit when said band is attached around said subject;

a power source disposed within said transmitter; and a switching mechanism rotatably mounted to said transmitter for activating said transmitter circuit by electrically connecting said power source to said transmitter circuit when said switching mechanism is rotated from a disengaged position to an engaged position, said switching mechanism including a first visual indicator that visually indicates that the switching mechanism is in the disengaged position and a second visual indicator that visually indicates that the switching mechanism is in the engaged position when the switching mechanism is rotated from the disengaged position to the engaged position, whereby said transmitter circuit generates said digitally encoded signal response to a discontinuity in said wire; and at least one receiving device for receiving said digitally encoded signal on said predetermined frequency from said transmitter, said receiving device comparing said digitally encoded signal with a predetermined value to selectively active an alarming mechanism.

10. The system as recited in claim 9 wherein said at least one transmitting device further comprises a plurality of transmitting devices and wherein said at least one receiving unit further comprises a plurality of receiving devices.

11. The system as recited in claim 10 wherein said receiving units determine which of said transmitting devices is transmitting said digitally encoded signal.

12. The system as recited in claim 10 further comprising a monitoring unit connected to each of said receiving units to provide a user interface to said system.

13. The system as recited in claim 9 wherein said transmitting device sends a initiation signal when said switching mechanism is engaged.

14. The system as recited in claim 10 wherein said visual indicator further including a first color to indicate said transmitter circuit is not activated and a second color to indicate said transmitter circuit is activated.

* * * * *